US010408169B2

(12) United States Patent
Zhang

(10) Patent No.: US 10,408,169 B2
(45) Date of Patent: Sep. 10, 2019

(54) EXHAUST GAS RECIRCULATION MIXER

(71) Applicant: Ford Global Technologies, LLC, Dearborn, MI (US)

(72) Inventor: Xiaogang Zhang, Novi, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 125 days.

(21) Appl. No.: 15/460,020

(22) Filed: Mar. 15, 2017

(65) Prior Publication Data

US 2018/0266366 A1 Sep. 20, 2018

(51) Int. Cl.
*F02M 26/19* (2016.01)
*F02M 26/21* (2016.01)

(52) U.S. Cl.
CPC ..... *F02M 26/19* (2016.02); *F02M 26/21* (2016.02)

(58) Field of Classification Search
CPC .... F02M 21/04; F02M 21/042; F02M 21/045; F02M 21/047; F02M 26/10; F02M 26/19; F02M 26/21; F02M 35/10118; F02M 35/10222; B01F 3/02
USPC ..... 123/568.17, 527, 590
See application file for complete search history.

(56) References Cited

U.S. PATENT DOCUMENTS 3,081,818 A * 3/1963 Braconier ..... B01F 3/02 431/346
3,438,198 A * 4/1969 Bentele ..... B01F 3/02 422/168
4,294,220 A * 10/1981 Yasuhara ..... F02M 26/15 123/568.11
5,377,646 A * 1/1995 Chasteen ..... F02D 19/023 123/527
5,916,831 A * 6/1999 Jager ..... F02M 19/035 123/527
6,267,106 B1 * 7/2001 Feucht ..... F02M 26/19 123/568.17
6,343,594 B1 * 2/2002 Koeslin ..... F02M 26/19 123/568.11
7,032,578 B2 4/2006 Liu et al.
7,624,575 B2 * 12/2009 Noelle ..... F01D 25/24 60/605.1
8,033,104 B2 10/2011 Zhang
(Continued)

FOREIGN PATENT DOCUMENTS

DE 2134100 A1 * 3/1973 ..... B01F 5/0212
JP 08319900 A * 12/1996 ..... F02M 26/19
(Continued)

OTHER PUBLICATIONS

Zhang, Xiaogang, "A Static Flow Mixer with Multiple Open Curved Channels," U.S. Appl. No. 14/934,753, filed Nov. 6, 2015, 49 pages.
(Continued)

*Primary Examiner* — John M Zaleskas
(74) *Attorney, Agent, or Firm* — Julia Voutyras; McCoy Russell LLP

(57) ABSTRACT

Methods and systems are provided for an exhaust gas recirculation mixer. In one example, a mixer may include a separate chambers configured to receive exhaust gas and intake gas, and where the exhaust gas and intake gas merge in an outlet of the mixer. The outlet of the mixer is located at an intersection of upstream and downstream surfaces of the mixer.

18 Claims, 4 Drawing Sheets

(56) References Cited

U.S. PATENT DOCUMENTS

| | | | | |
|---|---|---|---|---|
| 8,056,340 | B2 | 11/2011 | Vaught et al. | |
| 8,240,135 | B2 | 8/2012 | Zhang | |
| 8,322,138 | B2 * | 12/2012 | Jackson | F01M 13/022 123/572 |
| 9,255,504 | B2 | 2/2016 | Zhang | |
| 2003/0111065 | A1 * | 6/2003 | Blum | F02D 9/104 123/568.17 |
| 2003/0115871 | A1 * | 6/2003 | Feucht | F02D 9/104 60/605.1 |
| 2003/0115874 | A1 * | 6/2003 | Coleman | F02B 33/44 60/605.2 |
| 2006/0060172 | A1 * | 3/2006 | Liu | F02M 35/10118 123/568.17 |
| 2006/0060173 | A1 * | 3/2006 | Wei | F02B 29/0425 123/568.17 |
| 2006/0245296 | A1 * | 11/2006 | Nishioka | B01D 53/8631 366/174.1 |
| 2007/0256413 | A1 * | 11/2007 | Marsal | F02M 26/05 60/605.2 |
| 2007/0271920 | A1 * | 11/2007 | Marsal | F02M 26/06 60/605.2 |
| 2011/0146635 | A1 * | 6/2011 | Zeitoun | F02M 26/14 123/568.11 |
| 2011/0162360 | A1 * | 7/2011 | Vaught | F02B 33/44 60/605.2 |
| 2011/0265772 | A1 * | 11/2011 | Teng | F02B 31/04 123/568.11 |
| 2012/0167863 | A1 * | 7/2012 | Kulkarni | F02M 35/10222 123/568.17 |
| 2014/0331669 | A1 * | 11/2014 | Jones | F02M 25/0722 60/605.2 |
| 2016/0153404 | A1 * | 6/2016 | Guidi | F02M 26/19 123/568.17 |
| 2016/0326938 | A1 | 11/2016 | Zhang | |
| 2016/0376975 | A1 | 12/2016 | Zhang | |
| 2017/0044956 | A1 | 2/2017 | Zhang | |
| 2017/0128894 | A1 * | 5/2017 | Zhang | B01F 5/0602 |
| 2017/0138243 | A1 * | 5/2017 | Zhang | F01N 3/2892 |
| 2017/0234201 | A1 * | 8/2017 | Zhang | F01N 3/2892 60/286 |
| 2017/0254245 | A1 * | 9/2017 | Zhang | B01F 5/0461 |
| 2017/0276102 | A1 * | 9/2017 | Zhang | F02D 9/02 |
| 2018/0023447 | A1 * | 1/2018 | Zhang | B01F 5/0451 422/168 |
| 2018/0058294 | A1 * | 3/2018 | Zhang | B01F 5/0616 |
| 2018/0058388 | A1 * | 3/2018 | Zhang | F02M 26/19 |

FOREIGN PATENT DOCUMENTS

| | | | | |
|---|---|---|---|---|
| JP | 11324812 | A * | 11/1999 | F02M 26/07 |
| JP | 2000054915 | A * | 2/2000 | F02M 26/19 |
| WO | WO 9629511 | A1 * | 9/1996 | F02B 43/00 |
| WO | WO 2007115810 | A1 * | 10/2007 | B01F 3/02 |
| WO | WO 2015052970 | A1 * | 4/2015 | B01F 3/02 |

OTHER PUBLICATIONS

Zhang, Xiaogang, "Exhaust Gas Mixer," U.S. Appl. No. 14/943,620, filed Nov. 17, 2015, 45 pages.

Zhang, Xiaogang, et al., "Urea Mixer," U.S. Appl. No. 15/042,680, filed Feb. 12, 2016, 35 pages.

Zhang, Xiaogang, "Exhaust Gas Mixer," U.S. Appl. No. 15/247,683, filed Aug. 25, 2016, 52 pages.

Zhang, Xiaogang, "Systems and Methods for an Exhaust Gas Recirculation Mixer," U.S. Appl. No. 15/250,108, filed Aug. 29, 2016, 34 pages.

* cited by examiner

EXHAUST GAS RECIRCULATION MIXER

FIELD

The present description relates generally to an exhaust gas recirculation mixer.

BACKGROUND/SUMMARY

Higher combustion and exhaust temperatures may be exhibited during higher engine loads and/or boosted engine conditions. These higher temperatures may increase nitrogen oxide ($NO_x$) emissions and cause accelerated degradation of catalytic materials in the engine and exhaust system. Exhaust gas recirculation (EGR) is an approach to combat these effects. EGR strategies reduce an oxygen content of intake air by diluting it with exhaust. When the diluted air/exhaust mixture is used in place of ambient air not mixed with exhaust gas to support combustion in the engine, lower combustion and exhaust temperatures are exhibited. EGR also increases fuel economy in gasoline engines by reducing throttling losses and heat rejections.

To enable appropriate control of EGR dilution levels and maintain combustion stability, the EGR is homogenized with intake air via an EGR mixer, in some examples. One example approach is shown by Vaught et al. in U.S. Pat. No. 8,056,340. Therein, an annular EGR chamber is located annularly around an annular protrusion, which restricts a cross-sectional flow through area of an intake passage. The EGR chamber is fluidly coupled to a narrower portion of the intake passage where a vacuum may be formed to promote EGR mixing with intake air.

However, the inventors herein have recognized potential issues with such systems and have devised a series of approaches to address them. As one example, portions of intake air may flow through the annular protrusion without mixing with EGR. This may lead to poor EGR distribution, which may result in increased emissions and decreased combustion stability.

In one example, the issues described above may be addressed by a mixer comprising a hollow, annular ring having a first chamber fluidly coupled to an EGR passage and a second, separate chamber fluidly coupled to an intake passage via inlets located on a downstream surface and where the first and second chambers are fluidly coupled at an outlet located along an intersection between an upstream surface and the downstream surface adjacent to a restriction of an intake passage. In this way, EGR and intake gases combine before flowing to the intake passage.

As one example, the outlet is located along a portion of the intake passage where the mixer creates a greatest restriction. In this way, a vacuum may draw EGR and intake air from the first and second chambers, respectively, through the outlet, and into the intake passage. The second chamber is configured to receive gases at a location downstream of the outlet. As such, unmixed intake air (e.g., intake air free of EGR) and/or an intake air/EGR mixture may circulate through the mixer after flowing passage the outlet. This may increase a likelihood of mixing EGR with intake air. As such, distribution of EGR to each of the cylinders of an engine may be more uniform.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2-3 are shown approximately to scale.

DETAILED DESCRIPTION

Figure 1:
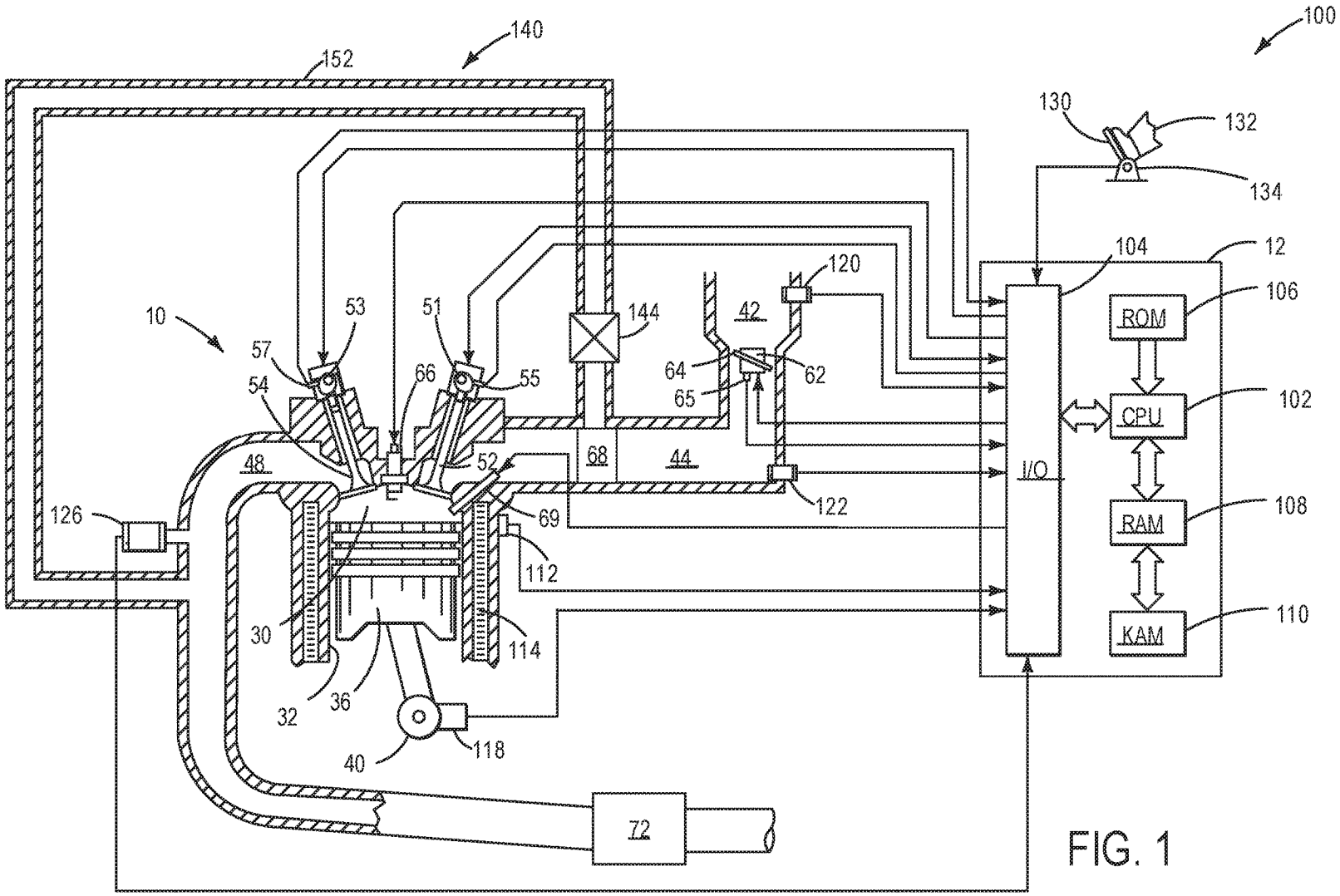
FIG. 1 shows an embodiment of an engine configured to receive exhaust gas recirculate.
Figure 2:
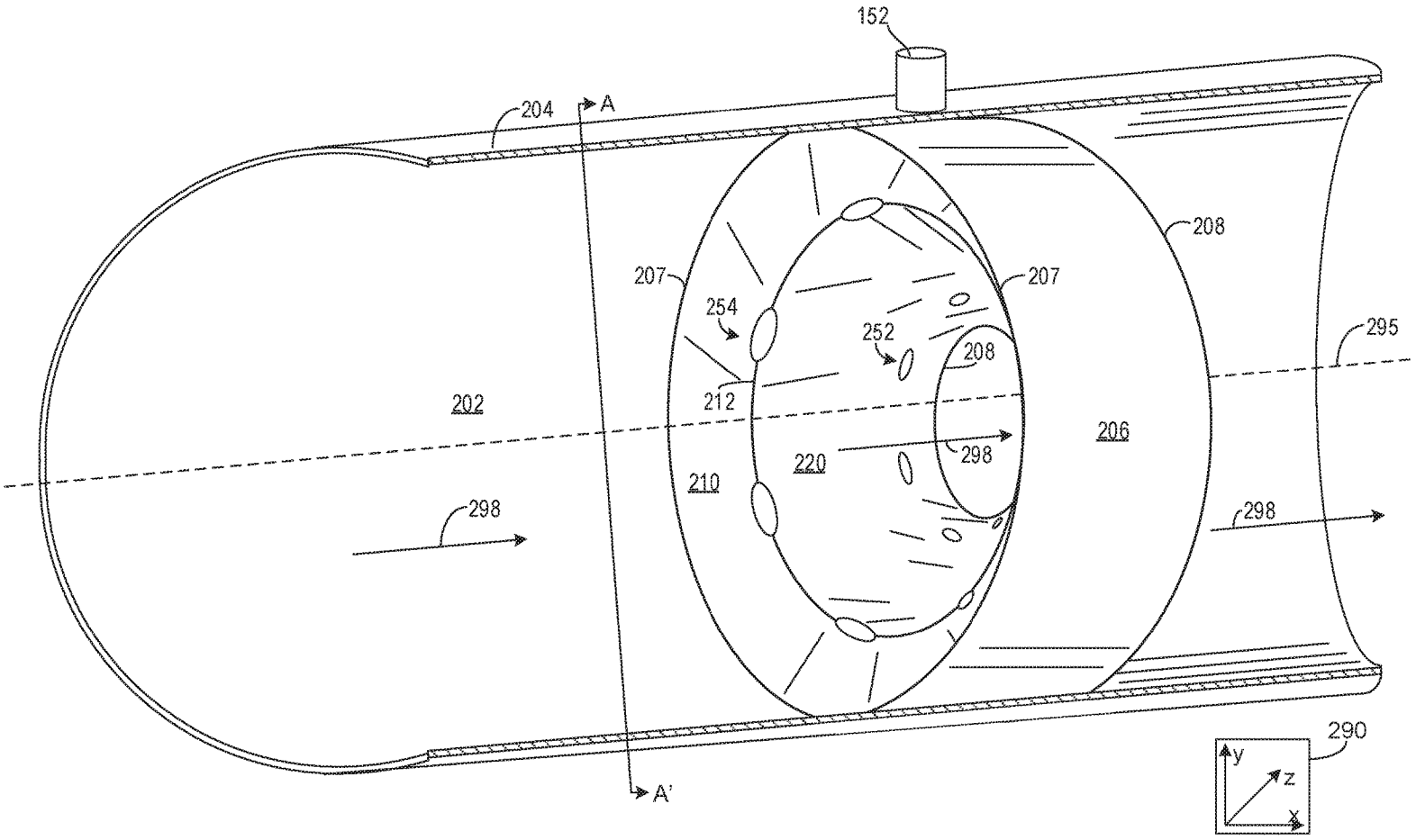
FIG. 2 shows an isometric view an exhaust gas recirculation (EGR) mixer arranged in an intake.
Figure 3:
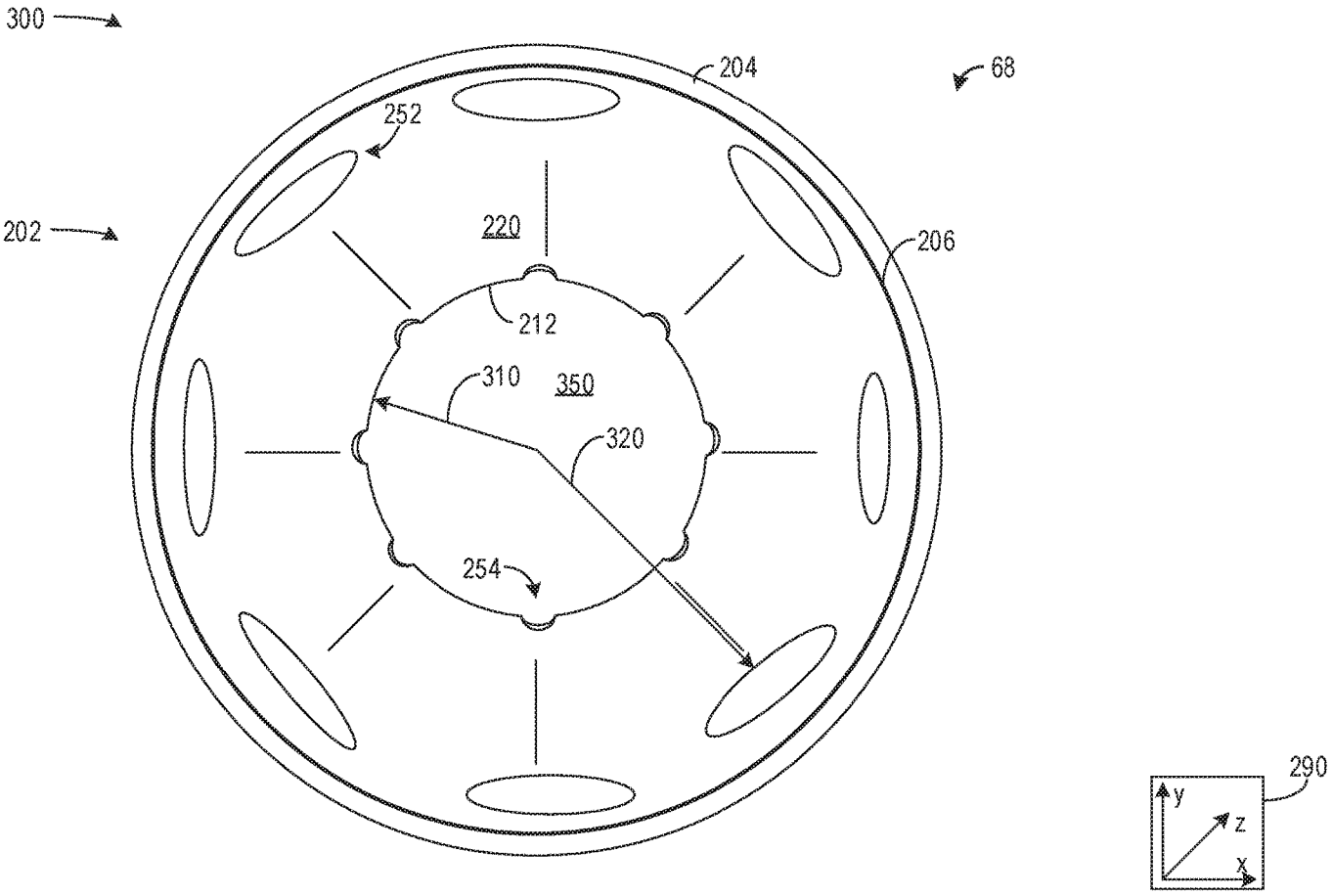
FIG. 3 shows a downstream-to-upstream view of the EGR mixer.

The following description relates to systems and methods for an exhaust gas recirculation mixer. The exhaust gas recirculation mixer may be located in an engine intake and fluidly coupled to an outlet of an EGR passage, as shown in FIG. 1. The mixer is a hollow annular ring with curved surfaces for increasing exhaust and intake gas mixing, as shown in FIG. 2. The mixer may restrict a portion of the engine intake such that a vacuum is created in the restriction. The mixer is symmetrically spaced about a central axis of an intake pipe such that an opening permits flow of intake air therethrough, as shown in FIG. 3. An example flow of intake and exhaust gases is shown in FIG. 4.

Figure 4:
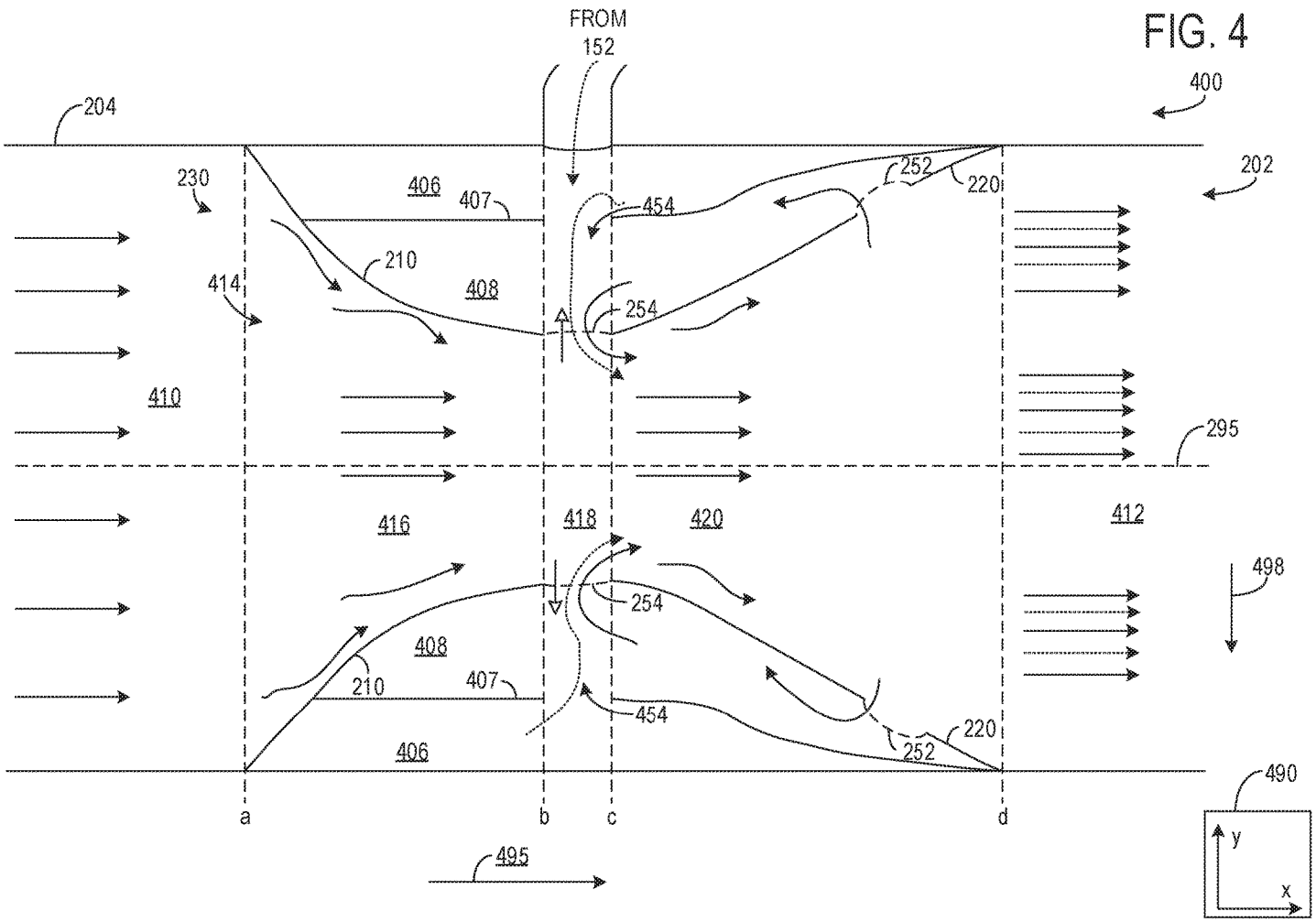
FIG. 4 shows a cross-sectional view of the EGR mixer according to a cutting plane illustrated in FIG. 2

FIGS. 2-4 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

The figures below describe a mixer comprising a hollow, annular ring having a first chamber fluidly coupled to an EGR passage and a second, separate chamber fluidly coupled to an intake passage via inlets located on a downstream surface and where the first and second chambers are fluidly coupled at an outlet located along an intersection between an upstream surface and the downstream surface adjacent to a restriction of an intake passage. There are exactly eight inlets and eight outlets. A radial height of the upstream surface decreases in an upstream direction from the intersection relative to a direction of intake air flow. A radial height of the downstream surface decreases in a downstream direction from the intersection relative to a direction of intake air flow.

The ring comprises an outer surface in face-sharing contact with an intake pipe. The restriction corresponds to a venturi throat of a venturi passage, the upstream surface corresponds to a venturi inlet of the venturi passage, and the downstream surface corresponds to a venturi outlet of the venturi passage, and where the venturi passage is located along an opening of the ring. The opening comprises a central axis parallel to a direction of exhaust gas flow. The mixer is fixed in the intake passage. The mixer is symmetric about a central axis of an intake pipe.

Continuing to FIG. 1, a schematic diagram showing one cylinder of a multi-cylinder engine 10 in an engine system 100, which may be included in a propulsion system of an automobile, is shown. The engine 10 may be controlled at least partially by a control system including a controller 12 and by input from a vehicle operator 132 via an input device 130. In this example, the input device 130 includes an accelerator pedal and a pedal position sensor 134 for generating a proportional pedal position signal. A combustion chamber 30 of the engine 10 may include a cylinder formed by cylinder walls 32 with a piston 36 positioned therein. The piston 36 may be coupled to a crankshaft 40 so that reciprocating motion of the piston is translated into rotational motion of the crankshaft. The crankshaft 40 may be coupled to at least one drive wheel of a vehicle via an intermediate transmission system. Further, a starter motor may be coupled to the crankshaft 40 via a flywheel to enable a starting operation of the engine 10.

The combustion chamber 30 may receive intake air from an intake manifold 44 via an intake passage 42 and may exhaust combustion gases via an exhaust passage 48. The intake manifold 44 and the exhaust passage 48 can selectively communicate with the combustion chamber 30 via respective intake valve 52 and exhaust valve 54. In some examples, the combustion chamber 30 may include two or more intake valves and/or two or more exhaust valves.

In this example, the intake valve 52 and exhaust valve 54 may be controlled by cam actuation via respective cam actuation systems 51 and 53. The cam actuation systems 51 and 53 may each include one or more cams and may utilize one or more of cam profile switching (CPS), variable cam timing (VCT), variable valve timing (VVT), and/or variable valve lift (VVL) systems that may be operated by the controller 12 to vary valve operation. The position of the intake valve 52 and exhaust valve 54 may be determined by position sensors 55 and 57, respectively. In alternative examples, the intake valve 52 and/or exhaust valve 54 may be controlled by electric valve actuation. For example, the cylinder 30 may alternatively include an intake valve controlled via electric valve actuation and an exhaust valve controlled via cam actuation including CPS and/or VCT systems.

A fuel injector 69 is shown coupled directly to combustion chamber 30 for injecting fuel directly therein in proportion to the pulse width of a signal received from the controller 12. In this manner, the fuel injector 69 provides what is known as direct injection of fuel into the combustion chamber 30. The fuel injector may be mounted in the side of the combustion chamber or in the top of the combustion chamber, for example. Fuel may be delivered to the fuel injector 69 by a fuel system (not shown) including a fuel tank, a fuel pump, and a fuel rail. In some examples, the combustion chamber 30 may alternatively or additionally include a fuel injector arranged in the intake manifold 44 in a configuration that provides what is known as port injection of fuel into the intake port upstream of the combustion chamber 30.

Spark is provided to combustion chamber 30 via spark plug 66. The ignition system may further comprise an ignition coil (not shown) for increasing voltage supplied to spark plug 66. In other examples, such as a diesel, spark plug 66 may be omitted.

The intake passage 42 may include a throttle 62 having a throttle plate 64. In this particular example, the position of throttle plate 64 may be varied by the controller 12 via a signal provided to an electric motor or actuator included with the throttle 62, a configuration that is commonly referred to as electronic throttle control (ETC). In this manner, the throttle 62 may be operated to vary the intake air provided to the combustion chamber 30 among other engine cylinders. The position of the throttle plate 64 may be provided to the controller 12 by a throttle position signal. The intake passage 42 may include a mass air flow sensor 120 and a manifold air pressure sensor 122 for sensing an amount of air entering engine 10.

An exhaust gas sensor 126 is shown coupled to the exhaust passage 48 upstream of an emission control device 72 according to a direction of exhaust flow. The sensor 126 may be any suitable sensor for providing an indication of exhaust gas air-fuel ratio such as a linear oxygen sensor or UEGO (universal or wide-range exhaust gas oxygen), a two-state oxygen sensor or EGO, a HEGO (heated EGO), a $NO_x$, HC, or CO sensor. In one example, upstream exhaust gas sensor 126 is a UEGO configured to provide output, such as a voltage signal, that is proportional to the amount of oxygen present in the exhaust. Controller 12 converts oxygen sensor output into exhaust gas air-fuel ratio via an oxygen sensor transfer function.

The emission control device 72 is shown arranged along the exhaust passage 48 downstream of both the exhaust gas sensor 126. The device 72 may be a three way catalyst (TWC), $NO_x$ trap, selective catalytic reductant (SCR), various other emission control devices, or combinations thereof. In some examples, during operation of the engine 10, the emission control device 72 may be periodically reset by operating at least one cylinder of the engine within a particular air-fuel ratio.

An exhaust gas recirculation (EGR) system 140 may route a desired portion of exhaust gas from the exhaust passage 48 to the intake manifold 44 via an EGR passage 152. The amount of EGR provided to the intake manifold 44 may be varied by the controller 12 via an EGR valve 144. Under some conditions, the EGR system 140 may be used to regulate the temperature of the air-fuel mixture within the combustion chamber, thus providing a method of controlling the timing of ignition during some combustion modes.

A mixer 68 is arranged at an intersection between the EGR passage 152 and the intake manifold 44. Alternatively, the EGR passage 152 may route exhaust gas to the intake passage 42, and as such, the mixer 68 is correspondingly arranged in the intake passage 42. The mixer 68 is configured to receive exhaust gas from the EGR passage 152 before the exhaust gas flows into the intake manifold 44. Said another way, exhaust gas from the EGR passage 152 flows directly into the mixer 68 without flowing through any other components. As will described in greater detail below, the mixer 68 is restricts a flow-through area of the intake to generate a vacuum. The mixer 68 further comprises chambers for receiving exhaust and intake gases which are drawn out of their respective chambers by the vacuum and may mix in the intake.

The controller 12 is shown in FIG. 1 as a microcomputer, including a microprocessor unit 102, input/output ports 104, an electronic storage medium for executable programs and calibration values shown as read only memory chip 106 (e.g., non-transitory memory) in this particular example, random access memory 108, keep alive memory 110, and a data bus. The controller 12 may receive various signals from sensors coupled to the engine 10, in addition to those signals previously discussed, including measurement of inducted mass air flow (MAF) from the mass air flow sensor 120; engine coolant temperature (ECT) from a temperature sensor 112 coupled to a cooling sleeve 114; an engine position signal from a Hall effect sensor 118 (or other type) sensing a position of crankshaft 40; throttle position from a throttle position sensor 65; and manifold absolute pressure (MAP) signal from the sensor 122. An engine speed signal may be generated by the controller 12 from crankshaft position sensor 118. Manifold pressure signal also provides an indication of vacuum, or pressure, in the intake manifold 44. Note that various combinations of the above sensors may be used, such as a MAF sensor without a MAP sensor, or vice versa. During engine operation, engine torque may be inferred from the output of MAP sensor 122 and engine speed. Further, this sensor, along with the detected engine speed, may be a basis for estimating charge (including air) inducted into the cylinder. In one example, the crankshaft position sensor 118, which is also used as an engine speed sensor, may produce a predetermined number of equally spaced pulses every revolution of the crankshaft.

The storage medium read-only memory 106 can be programmed with computer readable data representing non-transitory instructions executable by the processor 102 for performing the methods described below as well as other variants that are anticipated but not specifically listed.

The controller 12 receives signals from the various sensors of FIG. 1 and employs the various actuators of FIG. 1 to adjust engine operation based on the received signals and instructions stored on a memory of the controller.

Turning now to FIG. 2, it shows an embodiment 200 of an intake 202 comprising an intake pipe 204 with the mixer 68 coupled therein. As such, components previously present may be similarly numbered in subsequent figures. As shown, a portion of the intake pipe 204 is omitted to more clearly depict the mixer 68 located therein. When in its whole form, the intake pipe 204 is substantially cylindrical. In one example, the intake 202 may be substantially similar to intake manifold 44 of FIG. 1. Alternatively, the intake 202 may be substantially similar to intake passage 42 of FIG. 1.

An axis system 290 is shown comprising three axes, an x-axis in the horizontal direction, a y-axis in the vertical direction, and a z-axis in a direction perpendicular to both the x and y axes. A central axis 295 of the intake pipe 204 is shown by a dashed line. The mixer 68 may be symmetric about the central axis 295. An overall direction of intake air flow is depicted by arrows 298. As shown, intake air flows in a direction substantially parallel to the central axis 295. The embodiment 200 illustrates the mixer 68 from an upstream-to-downstream direction relative to the direction of intake air flow.

The mixer 68 may be a single machined piece. The mixer 68 may be composed of one or more of a ceramic material, a metal alloy, a silicon derivative, or other suitable materials capable of withstanding high temperatures while also mitigating friction experienced by an intake flow such that intake air flow is continuous. Additionally or alternatively, the mixer 68 may comprise of one or more coatings and materials such that exhaust may contact surfaces of the mixer 68 without depositing soot or other exhaust gas components on the mixer 68.

The intake pipe 204 is tubular and configured to conduct intake air (e.g., ambient air) through the intake 202. The mixer 68 is in face-sharing contact with an interior circumference of the intake pipe 204 via an outer annular surface 206 in such a way that gas may not flow between the outer annular surface 206 and the intake pipe 204. The outer annular surface 206 may be coupled to the intake pipe 204 via welds, adhesives, and/or other suitable coupling means providing a hermetic seal. In some embodiments, the mixer 68 may be forcibly slid into the intake 202. In this way, the mixer 68 comprises an outer circumference correspondingly smaller than the interior circumference of the intake pipe 204 such that the mixer 68 is located along the intake 202 while allowing substantially no gas to flow between the intake pipe 204 and the outer annular surface 206.

The outer annular surface 206 comprises a width equal to a distance between an upstream edge 207 and a downstream edge 208. A circumference of the upstream edge 207 is substantially equal to a circumference of the downstream edge 208. A first surface 210 of the mixer 200 is located between the upstream edge 207 and an annular intersect 212. A second surface 220 is located between the annular intersect 212 and the downstream edge 208. Therefore, the first inner surface 210 is located upstream of the second inner surface 220 relative to a direction of incoming intake air flow (e.g., arrows 298). The first inner surface 210 may herein be referred to as the upstream surface 210 and the second inner surface 220 may herein be referred to as the downstream surface 220. The upstream 210 and downstream 220 surfaces merge at the annular intersect 212.

In one example, the upstream edge 207 and the downstream edge 208 are flush with interior surfaces of the intake pipe 204. In this way, a transition from the interior surfaces of the intake pipe 204 to the first 210 and second 220 surfaces are uniform and smooth.

The upstream surface 210 and the downstream surface 220 extend from the outer annular surface 206 and radially protrude into the intake 202. In this way, a restriction of the intake 202 increases from the upstream edge 207 to the annular intersect 212. Likewise, the restriction of the intake 202 increases from the downstream edge 208 to the annular intersect 212. Said another way, a flow-through area of the intake 202 decreases from the upstream edge 207 to the intersect 212, where the flow-through area is most restricted at the intersect 212, and the restriction decreases from the intersect 212 to the downstream edge 208. This narrowing of the central intake passage may generate an inner passage (e.g., throat) of a venturi passage within the intake passage, as will be described in greater detail below. The upstream 210 and downstream 220 surfaces are radially spaced away from the central axis 295.

The upstream surface 210 is curved and becomes decreasingly radially spaced away from the central axis 295 in a downstream direction. The downstream surface 220 is curved and becomes increasingly radially spaced away from the central axis 295 in the downstream direction. As such, the upstream 210 and downstream 220 are annular. As an example, the upstream surface 210 may be outwardly curved and the downstream surface 220 may be inwardly curved relative to the central axis 295. In this way, the annular intersect 212, located at a merging of the upstream 210 and downstream 220 surfaces, is adjacent to a narrowest portion of the intake 202. It will be appreciated that the upstream surface 210 and the downstream surface 220 may be similarly curved without departing from the scope of the present disclosure.

As described above, the mixer 68 is hollow with annular chambers located therein for receiving intake air and exhaust gas (e.g., EGR). Specifically, a first annular chamber is configured to receive intake air via downstream surface perforations 252. A second annular chamber is configured to receive exhaust gas from the EGR passage 152. Both the first and second annular chambers expel intake air and exhaust gas, respectively, to the intake 202 via annular intersect perforations 254. The chambers span an entire 360 degree interior of the mixer 68 such that gases fill substantially an entire volume of the mixer 68. As shown, the downstream surface perforations 252 are located downstream of annular intersect perforations 254 relative to the direction of intake air flow. The downstream surface perforations 252 may be aligned with one another at a common axial position along intake flow through the intake 202, as can annular intersect perforations 254.

Downstream surface perforations 252 may admit intake air in a plurality of directions further including at least a first direction oblique to arrows 298 and a second direction perpendicular to arrows 298 into the mixer 68. At any rate, the downstream surface perforations 252 admit intake air into the mixer 68 in a radially outward direction relative to the central axis 295. A cutout in the intake pipe 204 allows the EGR passage 152 to expel exhaust gas into the mixer 68. There are no intervening components located between the EGR passage 152 and the mixer 68. Therefore, exhaust gas flows directly from the EGR passage 152 to the mixer 68. Exhaust gas may flow from the EGR passage 152 to the mixer 68 in a substantially radially inward direction relative to the central axis 295. The mixer 68 comprises no other inlets and no additional outlets other than the downstream surface perforations 252, the annular intersect perforations 254, and the cutout fluidly coupling the EGR passage 152 to the mixer 68. As an example, the upstream surface 210 and the downstream surface 220 are continuous and are the only walls (surfaces) separating the chambers from the intake 202. As such, the upstream surface 210 and downstream surface 220 are impervious to gas flow.

Thus, an exhaust gas recirculation mixer comprises a curved upstream surface and a curved downstream surface intersecting along a venturi throat, a plurality of outlets located adjacent to the throat and a plurality of inlets located adjacent to a venturi outlet, and an EGR outlet positioned to flow EGR along an axis of the throat into a first chamber radial exterior to a second chamber configured to receive intake air via the plurality of inlets, and where the chambers are located between the upstream and downstream surfaces.

The plurality of inlets includes eight circular openings facing a downstream direction relative to a direction of intake air flow. The upstream surface increases in radial height from an upstream portion of a venturi inlet to the throat and where the downstream surface decreases in radial height from the throat to a downstream portion of the venturi outlet. The first chamber is fluidly separated from the second chamber except at a conduit fluidly coupling the first and second chambers to the venturi throat. The upstream surface, downstream surface, first chamber, and second chamber are annular. There are no other inlet and no additional outlets.

FIG. 3 shows a downstream-to-upstream view 300 of the mixer 68, which is opposite the view shown in FIG. 2. The mixer 68 is in face-sharing contact with interior surfaces of the intake pipe 204. An upstream surface (e.g., upstream surface 210) is occluded in the downstream-to-upstream view 300. The axis system 290 comprising three axes, an x-axis in the horizontal direction, a y-axis in the vertical direction, and a z-axis in a direction perpendicular to the x and y axes is shown.

The mixer 68 is hermetically sealed and fully enclosed from an ambient atmosphere outside the intake pipe 204 via a coupling between the intake pipe and an outer annular surface 206. The mixer 200 receives intake via one or more downstream surface perforations 252. Annular intersect perforations 254 are located upstream of the downstream surface perforations 252. Herein, the annular intersect perforations 254 may be interchangeably referred to as outlets 254 and downstream surface perforations 252 may be referred to as inlets 252.

As shown, the mixer 68 extends from the intake pipe 204 toward a center of the intake 202. The mixer 68 is shown spaced away from the center of the intake 202, and as a result, an opening 350 is located along the center of the intake 202 corresponding to a location of the mixer 68. The opening 350 permits intake gas to flow through the mixer 68. In some examples, intake gas may flow uninterruptedly through the opening without interacting with the mixer 68. Due to the shape of the mixer 68 described above, a diameter of the opening is smallest at the annular intersect 212 and largest at extreme ends of the mixer (e.g., upstream edge 207 and downstream edge 208 of FIG. 1).

The outlets 254 and inlets 252 are radially aligned with one another. In some examples, the inlets and the outlets may be radially misaligned. An opening size of the inlets 252 may be larger than an opening size of the outlets 254, in one example. In another example, opening sizes of the inlets 252 and the outlets 254 are substantially identical. Substantially identical may be defined as a deviation between an opening size of the inlets 250 and an opening size of the outlets being within 1-5% due to manufacturing intolerances.

As described above, the downstream surface 220 is angled upward from the downstream edge 208 to the annular intersect 212. As such, the inlets 252 are angled relative to a direction of incoming intake gas flow. However, the outlets 254 are perpendicular to intake gas flow and arranged along cutting plane upstream of the inlets 252. This may improve mixing in the intake when gases expelled from the mixer 68 collide with incoming intake gas at a 90 degree angle, which may increase an overall turbulence of gas flow through the portion of the intake 202 downstream of the mixer 68. Inlets 252 face a downstream direction partly parallel and oblique to incoming intake gas flow. Intake gas may bend and/or divert its flow direction to enter the inlets. This may improve a swirling and/or turbulence of intake gas in the mixer 68, which may result in increased mixing of EGR with intake gas.

A number of inlets may be substantially equal to a number of outlets. Alternatively, the number of inlets and/or outlets may be altered based on an opening size. As an example, the numbers of inlets and outlets may be unequal, but a total opening size of the inlets may be substantially equal to a total opening size of the outlets. The total opening size may be calculated by summing an individual opening size of an inlet or an outlet. In this way, a flow rate through the inlets may be equal to a flow rate through the outlets. The inlets 252 and outlets 254 may be oblong as an example. In other examples, the inlets 252 and outlets 254 may be circular, square, diamond, triangular, hexagonal, or other suitable shapes.

A first radius 310 of the mixer 68 extends from a center of the intake 202 to the annular intersect 212. A second radius 320 of the mixer 200 extends from the center of the intake 202 to a circumference of the downstream surface 220 corresponding to the inlets 202. The first radius 310 is shorter than the second radius 320. In this way, the inlets 252 may receive gases from a more outer region (closer to the intake pipe 204) and the outlets 254 expel gases to a more central region (closer to a central axis (e.g., central axis 295 of FIG. 2) of the intake pipe 204).

FIG. 4 shows a side-on cross-section 400 according to cutting plane A-A' of FIG. 2 depicting an exemplary flow of intake gas through the mixer 68 in conjunction with EGR flow. Upstream and downstream directions may be described below relative to a general direction of intake flow parallel with arrow 495.

An axis system 490 comprises two axes, an x-axis in the horizontal direction and a y-axis in the vertical direction. A central axis 295 of the intake pipe 204 is shown via a dashed line. Arrow 498 indicates a downward direction parallel to a force of gravity. The intake 202 comprises an upstream intake passage 410 and a downstream intake passage 412 with an interior passage 414 (e.g., central intake passage) located therebetween. As shown, the interior passage 414 is arranged along the opening 350 of the mixer 68. The upstream intake passage 410 is located upstream and outside of the mixer 68 and the downstream intake passage 412 is located downstream and outside of the mixer 68.

The mixer 68 comprises a curved upstream surface 210 located between dashed lines a and b, an annular intersect 212 located between lines b and c, and a curved downstream side located between lines c and d. A radial height of the mixer increases from line a to line b. A radial height may be defined as a length of the mixer 68 extending from the intake pipe 204 to the central axis 295 (e.g., a protrusion of the mixer 68 into the interior passage 414). The radial height is substantially constant and equal to a maximum radial height of the mixer 68 between lines b and c, where deviations may occur at outlets 254. The radial height of the mixer decreases between line c to line d, where a rate at which the radial height decreases from line c to line d is less than a rate at which the radial height increase from line a to line b. In this way, the upstream surface 210 has a greater slope than the downstream surface 220.

Said another way, a diameter of the opening 350 decreases from line a to line b, remains substantially equal to a smallest diameter of the opening 350 from line b to line c, and increases from line c to line d. The opening 350 extends between lines a to d, where a venturi passage is formed. Therefore, interior passage 414 may herein be referred to as venturi passage 414. The venturi passage 414 comprises a venturi inlet 416 located between line a and line b. Therefore, the region between lines a and b may be referred to herein as the venturi inlet 416. The venturi passage 414 further comprises a venturi outlet 420 located between lines c and d. Therefore, the region between lines c and d may herein be referred to as the venturi outlet 420. The venturi passage further comprises a throat 418 located between lines b and c, fluidly coupling the venturi inlet 416 and the venturi outlet 420. The region between lines b and c may be referred to herein as the throat 418.

The radial height of the mixer 200 is inversely proportional to a diameter of the venturi passage 414. Therefore, the diameter of the venturi inlet 416 decreases in a downstream direction and the diameter of the venturi outlet 420 increases in the downstream direction in a manner corresponding to the curvature of the upstream surface 210 and the downstream surface 220, respectively. The diameter of the throat 418 is the smallest diameter of the venturi passage 414. Thus, the throat 418 is sized to decrease a pressure of exhaust gas while increasing a velocity of exhaust gas flowing through the venturi passage 414, thereby providing a vacuum to interior portions of the mixer 68 via the outlets 254.

The following description relates to the flow of intake gas and exhaust gas in the intake 202 and mixer 68. Intake gas is depicted by solid line arrows. Exhaust gas is depicted by dashed line arrows. A vacuum flow is shown by unfilled (white) arrowhead arrows.

Intake gas flowing through the intake 202 flows from the upstream intake passage 410 and into the venturi passage 414 in the opening 350. Intake gas flows into the venturi inlet 416, where exhaust gas may contact the upstream surface 210. In one example, intake gas proximal to the intake pipe 204 contacts the upstream surface 210, where the intake gas may ricochet in a number of directions oblique to its original flow path. Intake gas proximal to the central axis 295 may not contact the upstream surface 210, where its flow path may be uninterrupted or may be altered due to collisions occurring between it and intake gas colliding with the upstream surface 210.

Intake gas flows proximally to the central axis 295 from the venturi inlet 416 to the throat 418. A pressure of intake gas in the throat 418 is less than a pressure of exhaust gas in the venturi inlet 416. This generates a vacuum adjacent the outlets 254, which may be supplied to a first annular chamber 406 and a second annular chamber 408. A strength of the vacuum generated may be based on an intake gas flow rate and/or an engine load. In some embodiments, the strength of the vacuum may be increased by actuating a variable venturi device toward the mixer 200 (not shown). In one example, the variable venturi device restricts a flow through area of the venturi inlet 416, thereby increasing an amount of vacuum generated. Intake gas in the throat 418 may flow passed the outlets 254 due to its increased velocity compared to the venturi inlet 416.

Intake gas may flow away from the central axis 295 as it flows from the throat 418 to the venturi outlet 420. A portion of intake gas may flow through the venturi outlet 420 and into the downstream intake passage 412 uninterruptedly while a remaining portion of exhaust gas in the venturi outlet 420 may flow through the inlets 252 and into the second annular chamber 408. Intake gas flow through the inlets 252 may be promoted by the vacuum supplied to the mixer 68. Intake gas flowing through the inlets may flow in a plurality of angles including a first angle perpendicular to the arrow 495 and a second angle oblique to the arrow 495. These changes in intake flow direction may increase a mixing ability turbulence created in the second annular chamber 408.

Exhaust gas flows uninterruptedly from the EGR passage 152 into the first annular passage 406. In this way, there are no intervening components located between the EGR passage 152 and the mixer 68. Exhaust gas in the first annular chamber 406 may flow through portions of the mixer 68 above and below the central axis 295. As shown in FIG. 2, the mixer 200 is contiguous about an entire circumference of the intake pipe 204. This allows the exhaust gas in the first annular chamber 406 to flow uninterruptedly through the chamber. Intake gas in the second annular chamber 408 may also flow through portions of the mixer 68 above and below the central axis 295.

As shown, the first annular chamber 406 is located adjacent to the intake pipe 204 and the second annular chamber 408 is located proximal to the central axis 295. The first annular chamber 406 is fluidly separated from the second annular chamber 408. As shown, an annular surface 407 separates the first 406 and second 408 annular chambers. As shown, the annular surface 407 is physically coupled to the upstream surface 210 and the downstream surface 220. The annular surface 407 is impervious to gas flow. In this way, intake gas does not enter the first annular chamber 406. Additionally, exhaust gas does not enter the second annular chamber 408 from the first annular chamber 406.

The annular surface 407 comprises a plurality of cutouts aligned with the outlets 254 such that a conduit 454 is formed. The conduit 454 is configured to receive exhaust gases from the first annular chamber 406, intake gases from the second annular chamber 408, and vacuum from the throat 418. Exhaust gas and intake gas may mix in the conduit 454 prior to flowing through the outlets 254 and into the throat 418. In one example, the intake and exhaust gases may flow through the outlets 254 at a first angle perpendicular to the arrow 495. As shown, there is at least one conduit of the conduits 454 for each outlet of the outlets 254.

Intake and exhaust gases flowing through the outlets 254 may merge with unmixed intake gas proximal to the central axis 295 in the throat 418. Thus, exhaust gas is diluted and dispersed into more intake air in the venturi throat 418. The exhaust gas and intake air flow into the venturi outlet 420 where the intake and exhaust gases may flow to an engine (e.g., engine 10 of FIG. 1) via the downstream intake passage 412 or into the mixer 68 via the inlets 452. In this way, EGR (exhaust gas) is more evenly distributed to each cylinder of the engine compared to an intake that does not include a mixer.

Thus, a method for mixing exhaust gas and intake gas comprises flowing EGR into a first annular chamber of a mixer, flowing intake air into a second annular chamber of the mixer fluidly separated from the first chamber, and combining the EGR and intake air in a conduit of the mixer fluidly coupled to a restricted portion of an intake passage. The second annular chamber is fluidly coupled to the intake passage via a plurality downstream facing inlets relative to a direction of intake air flow. The EGR flows through the first annular chamber and the conduit before flowing to the intake passage. The method further includes flowing the EGR and intake air to an internal combustion engine of a vehicle.

In this way, an exhaust gas recirculation mixer is configured to receive exhaust gas and intake air via two separate chambers. Intake and exhaust gases flow out of the chambers as intake air flows through a restriction created by the mixer. The technical effect of flowing intake and exhaust gas into two separate chambers is to increase mixing and turbulence generated when the exhaust gas and intake gas collide in an outlet of the mixer. By doing this, combustion stability and emission reduction is preserved during engine EGR demand conditions.

Thus, an embodiment of a mixer comprising a hollow, annular ring having a first chamber fluidly coupled to an EGR passage and a second, separate chamber fluidly coupled to an intake passage via inlets located on a downstream surface and where the first and second chambers are fluidly coupled at an outlet located along an intersection between an upstream surface and the downstream surface adjacent to a restriction of an intake passage. A first example of the mixer further includes where there are exactly eight inlets and eight outlets. A second example of the mixer, optionally including the first example, further includes where a radial height of the upstream surface decreases in an upstream direction from the intersection relative to a direction of intake air flow. A third example of the mixer, optionally including the first and/or second examples, further includes where a radial height of the downstream surface decreases in a downstream direction from the intersection relative to a direction of intake air flow. A fourth example of the mixer, optionally including one or more of the first through third examples, further includes where the ring comprises an outer surface in face-sharing contact with an intake pipe. A fifth example of the mixer, optionally including one or more of the first through fourth examples, further includes where the restriction corresponds to a venturi throat of a venturi passage, the upstream surface corresponds to a venturi inlet of the venturi passage, and the downstream surface corresponds to a venturi outlet of the venturi passage, and where the venturi passage is located along an opening of the ring. A sixth example of the mixer, optionally including one or more of the first through fifth examples, further includes where the opening comprises a central axis parallel to a direction of exhaust gas flow. A seventh example of the mixer, optionally including one or more of the first through sixth examples, further includes where the mixer is fixed in the intake passage. An eighth example of the mixer, optionally including one or more of the first through seventh examples further includes where the mixer is symmetric about a central axis of an intake pipe.

An embodiment of a method comprises flowing EGR into a first annular chamber of a mixer, flowing intake air into a second annular chamber of the mixer fluidly separated from the first chamber, and combining the EGR and intake air in a conduit of the mixer fluidly coupled to a restricted portion of an intake passage. A first example of the method where the second annular chamber is fluidly coupled to the intake passage via a plurality downstream facing inlets relative to a direction of intake air flow. A second example of the method, optionally including the first example, further includes where EGR flows through the first annular chamber and the conduit before flowing to the intake passage. A third example of the method, optionally including the first and/or second examples, further includes flowing the EGR and intake air to an internal combustion engine of a vehicle.

An exhaust gas recirculation (EGR) mixer comprises a curved upstream surface and a curved downstream surface intersecting along a venturi throat, a plurality of outlets located adjacent to the throat and a plurality of inlets located adjacent to a venturi outlet, and an EGR outlet positioned to flow EGR along an axis of the throat into a first chamber radial exterior to a second chamber configured to receive intake air via the plurality of inlets, and where the chambers are located between the upstream and downstream surfaces. A first example of the EGR mixer further includes where the plurality of inlets includes eight circular openings facing a downstream direction relative to a direction of intake air flow. A second example of the EGR mixer, optionally including the first example, further includes where the upstream surface increases in radial height from an upstream portion of a venturi inlet to the throat and where the downstream surface decreases in radial height from the throat to a downstream portion of the venturi outlet. A third example of the EGR mixer, optionally including the first and/or second examples, further includes where the first chamber is fluidly separated from the second chamber except at a conduit fluidly coupling the first and second chambers to the venturi throat. A fourth example of the EGR mixer, optionally including one or more of the first through third examples, further includes where the conduit is one conduit of a plurality of conduits and where a number of conduits is equal to a number of outlets. A fifth example of the EGR mixer, optionally including one or more of the first through fourth examples, the upstream surface, downstream surface, first chamber, and second chamber are annular. A sixth example of the EGR mixer, optionally including one or more of the first through fifth examples, there are no other inlet and no additional outlets.

Note that FIG. 4 shows arrows indicating where there is space for gas to flow, and the solid lines of the device walls shows where flow is blocked and communication is not possible due to the lack of fluidic communication created by the device walls spanning from one point to another. The walls create separation between regions, except for openings in the wall which allow for the described fluid communication.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A mixer comprising:

a hollow, annular ring, wherein an outer annular surface of the annular ring is in face-sharing contact with an interior circumference of an intake pipe of an intake passage, the annular ring further comprising a first chamber fluidly coupled to an EGR passage and a second, separate chamber fluidly coupled to the intake passage via inlets located on a downstream surface and where the first and second chambers are fluidly coupled by at least one conduit located along an intersection between an upstream surface and the downstream surface adjacent to a restriction of the intake passage, wherein the restriction corresponds to a venturi throat of a venturi passage, wherein the venturi passage is located within the intake passage, the upstream surface corresponds to a venturi inlet of the venturi passage, and the downstream surface corresponds to a venturi outlet of the venturi passage, and where the venturi passage is located along an opening of the annular ring, wherein the opening comprises a central axis parallel to a central axis of the intake passage, wherein the at least one conduit is shaped to flow intake and exhaust gases in a direction perpendicular to the central axis of the intake passage.

2. The mixer of claim 1, wherein the inlets consist of exactly eight inlets, and wherein the at least one conduit consists of exactly eight conduits.

3. The mixer of claim 1, wherein a radial height of the upstream surface decreases in an upstream direction from the intersection relative to a direction of intake air flow.

4. The mixer of claim 1, wherein a radial height of the downstream surface decreases in a downstream direction from the intersection relative to a direction of intake air flow.

5. The mixer of claim 1, wherein the at least one conduit comprises a circular opening.

6. The mixer of claim 1, wherein the first chamber and the second chamber are fluidly separated from one another via an annular surface, wherein the annular surface comprises at least one cutout aligned with at least one outlet to shape the at least one conduit.

7. The mixer of claim 1, wherein the mixer is fixed in the intake passage.

8. The mixer of claim 1, wherein the mixer is symmetric about the central axis of the intake passage.

9. A method comprising:

flowing EGR into a first annular chamber of a mixer;

flowing intake air into a second annular chamber of the mixer fluidly separated from the first annular chamber; and combining the EGR and the intake air in a conduit of the mixer fluidly coupled to a restricted portion of an intake passage;

flowing the EGR and the intake air through the conduit in a direction perpendicular to a central axis of the intake passage, and wherein an outer annular surface of the mixer is in face-sharing contact with an interior circumference of an intake pipe of the intake passage.

10. The method of claim 9, wherein the second annular chamber is fluidly coupled to the intake passage via a plurality of inlets that face downstream relative to a direction of intake air flow.

11. The method of claim 9, further comprising flowing the EGR and the intake air to an internal combustion engine of a vehicle.

12. An exhaust gas recirculation mixer comprising:

a curved upstream surface and a curved downstream surface intersecting along a venturi throat;

an outer annular surface having an outer circumference correspondingly smaller than an interior circumference of an intake pipe, wherein the exhaust gas recirculation mixer is located within the intake pipe;

a first chamber fluidically coupled to a second chamber at a plurality of perforations in an annular surface dividing the first chamber and the second chamber, wherein the annular surface is physically coupled to the curved upstream surface and the curved downstream surface;

a plurality of outlets located adjacent to the venturi throat fluidly coupling the second chamber with the intake pipe, wherein the plurality of outlets is aligned with the plurality of perforations, and a plurality of inlets located adjacent to a venturi outlet fluidly coupling the intake pipe with the second chamber; and an EGR outlet positioned to flow EGR along an axis of the venturi throat into the first chamber, wherein the first chamber is radially exterior to the second chamber, and wherein the second chamber is configured to receive intake air via the plurality of inlets, and where the first chamber and the second chamber are located between the curved upstream and downstream surfaces.

13. The exhaust gas recirculation mixer of claim 12, wherein the plurality of inlets includes no more than eight circular openings facing a downstream direction relative to a direction of intake air flow.

14. The exhaust gas recirculation mixer of claim 12, wherein the curved upstream surface increases in radial height from an upstream portion of a venturi inlet to the venturi throat and where the curved downstream surface decreases in radial height from the venturi throat to a downstream portion of the venturi outlet.

15. The exhaust gas recirculation mixer of claim 12, wherein the first chamber is fluidly separated from the second chamber by the annular surface except at the plurality of perforations fluidly coupling the first and second chambers to the venturi throat.

16. The exhaust gas recirculation mixer of claim 15, wherein a number of the plurality of outlets is equal to a number of the plurality of perforations, and wherein each of the plurality of outlets comprises a circular opening.

17. The exhaust gas recirculation mixer of claim 16, wherein the curved upstream surface, the curved downstream surface, the first chamber, and the second chamber are annular.

18. The exhaust gas recirculation mixer of claim 12, wherein the second chamber comprises no other inlets, no other perforations, and no additional outlets.

* * * * *